United States Patent [19]

Bradley

[11] 4,360,194

[45] Nov. 23, 1982

[54] WEB UNIT HANDLING METHOD AND APPARATUS

[75] Inventor: John J. Bradley, Green Bay, Wis.

[73] Assignee: Paper Converting Machine Company, Green Bay, Wis.

[21] Appl. No.: 167,810

[22] Filed: Jul. 14, 1980

Related U.S. Application Data

[63] Continuation-in-part of Ser. No. 86,158, Oct. 8, 1979, abandoned.

[51] Int. Cl.[3] ..... B42C 1/10

[52] U.S. Cl. ..... 270/51; 270/54

[58] Field of Search ..... 270/32–52, 270/58, 54; 493/432, 435, 440

[56] References Cited

U.S. PATENT DOCUMENTS

| | | | |
|---|---|---|---|
| 1,845,895 | 2/1932 | Voorhis | 493/440 |
| 3,740,049 | 6/1973 | Fisher | 270/41 |
| 3,870,292 | 3/1975 | Bradley | 493/435 |
| 3,948,504 | 4/1976 | Woessner | 270/41 |

*Primary Examiner*—Richard J. Apley
*Assistant Examiner*—A. Heinz
*Attorney, Agent, or Firm*—Tilton, Fallon, Lungmus & Chestnut

[57] ABSTRACT

A web unit handling method and apparatus wherein a plurality of web units are separately advanced along a plurality of delivery paths which are aligned along a lineal collection path, each web unit being transferred into the collection path and thereafter being advanced therein in synchronism with the other web units being transferred into the path.

6 Claims, 7 Drawing Figures

WEB UNIT HANDLING METHOD AND APPARATUS

This application is a continuation-in-part of my copending application Ser. No. 86,158, filed Oct. 8, 1979, now abandoned.

BACKGROUND AND SUMMARY OF INVENTION

This invention relates to web unit handling method and apparatus and, more particularly, to a method and apparatus which presents web units in convenient substacks for rapid and reliable accumulation into larger stacks.

The invention finds advantageous application to the handling of folded web units such as tissues and paper napkins and thus will be discussed generally in that context although many other types of web units, folded or unfolded, can be handled advantageously through the practice of the invention. For example, the invention finds application in the production of separate substacks of flat sheets, of longitudinally but not transversely folded sheets, of flat sheets not longitudinally folded but single transverse folded (here the single fold does not have to define two equal panels), of longitudinally and transversely folded web segments—like a napkin or a multiple longitudinal fold and a single transverse fold like a hanky or non-longitudinally folded product which is double transverse folded, and of longitudinally folded and double transverse folded product—like a dinner size double transverse folded napkin.

A number of drawbacks attended the previous production of paper napkins. Foremost among these was a speed limitation of the order of 600–750 napkins per minute, per lane, this stemming from the arrangement of the folding and stacking mechanisms. Widening the machine was unattractive because of the substantially increased expense and difficulties of operation.

These difficulties and limitations have been avoided through the practice of the invention which involves separately advancing a plurality of web units along the same plurality of delivery paths, the delivery paths being aligned along a linear collection path. Thereafter, the web units are transferred into the collection path and advanced thereon in synchronism with other web units being transferred to the collection path to deliver a series of substacks which are then accumulated into the desired stack or "count".

Other objects and advantages of the invention can be seen in the details of the ensuing detailed description.

DETAILED DESCRIPTION

The invention is described in conjunction with an illustrative embodiment in the accompanying drawing, in which—

Figure 1:
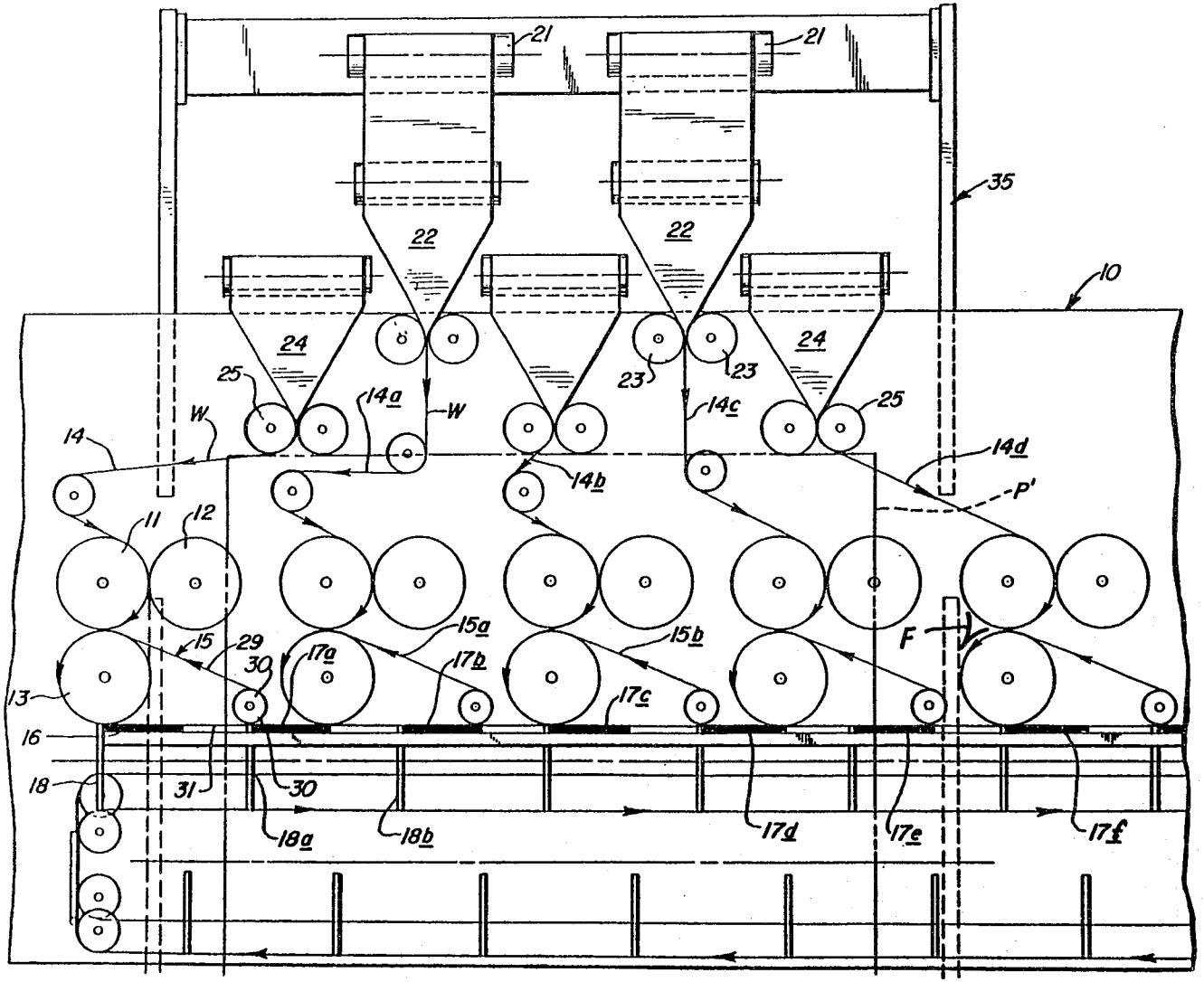
FIG. 1 is a fragmentary side elevational view of apparatus employed in the practice of the invention.

In the illustration given and with reference first to FIG. 1, the numeral 10 designates generally the frame of the machine which is seen only in fragmentary form. The frame 10 supports a plurality of sets of rolls, the most left hand set including a carrier roll 11, a cutoff roll 12 and a folding roll 13. These rolls 11–13 define in part a delivery path 14 for a web W which is converted into sequential web units and transferred by means of a transfer mechanism generally designated 15 to a collection conveyor 16.

The collection conveyor 16 advances each web unit 17 in synchronism with the speed of the web units being delivered along the various delivery paths 14, **14*a*, 14*b*, etc. If, for example, the webs W are being processed to provide 600 units per minute, i.e., ten per second, the conveyor 16 in the collection path advances each substack or unit 17, 17*a*, 17*b*, etc., one repeat length (i.e., between consecutive pushers 18, 18*a*, etc.) in 1/10 second so as to position a substack 17, 17*a*, etc. under the transfer mechanism 15, 15*a*, 15*b*, etc., at the time the web unit being delivered by that mechanism is deposited—so that the substack 17*f* (at the right hand side of FIG. 1) is five units high. Here it should be appreciated that the pushers 18, 18*a*, 18*b* are not spaced apart by the distance between transfer mechanisms 15, 15*a*, etc., but rather by a distance corresponding to the length of the web unit, which facilitates subsequent accumulation for stacking purposes. In the illustration given for a 13″×13″ quarter folded napkin, the distance between the pushers 18, 18*a*, 18*b*, etc., is 13″, corresponding to a folded product length of 6½″. Thus, the collection conveyor 16 advances at the rate of 130″ per second with the spacing between corresponding portions of the transfer mechanisms 15, 15*a***, etc., not necessarily being related to the 13″ distance between pushers, since the plurality of folding mechanisms do not have to rotate in synchronism to each other.

Figures 2, 5:
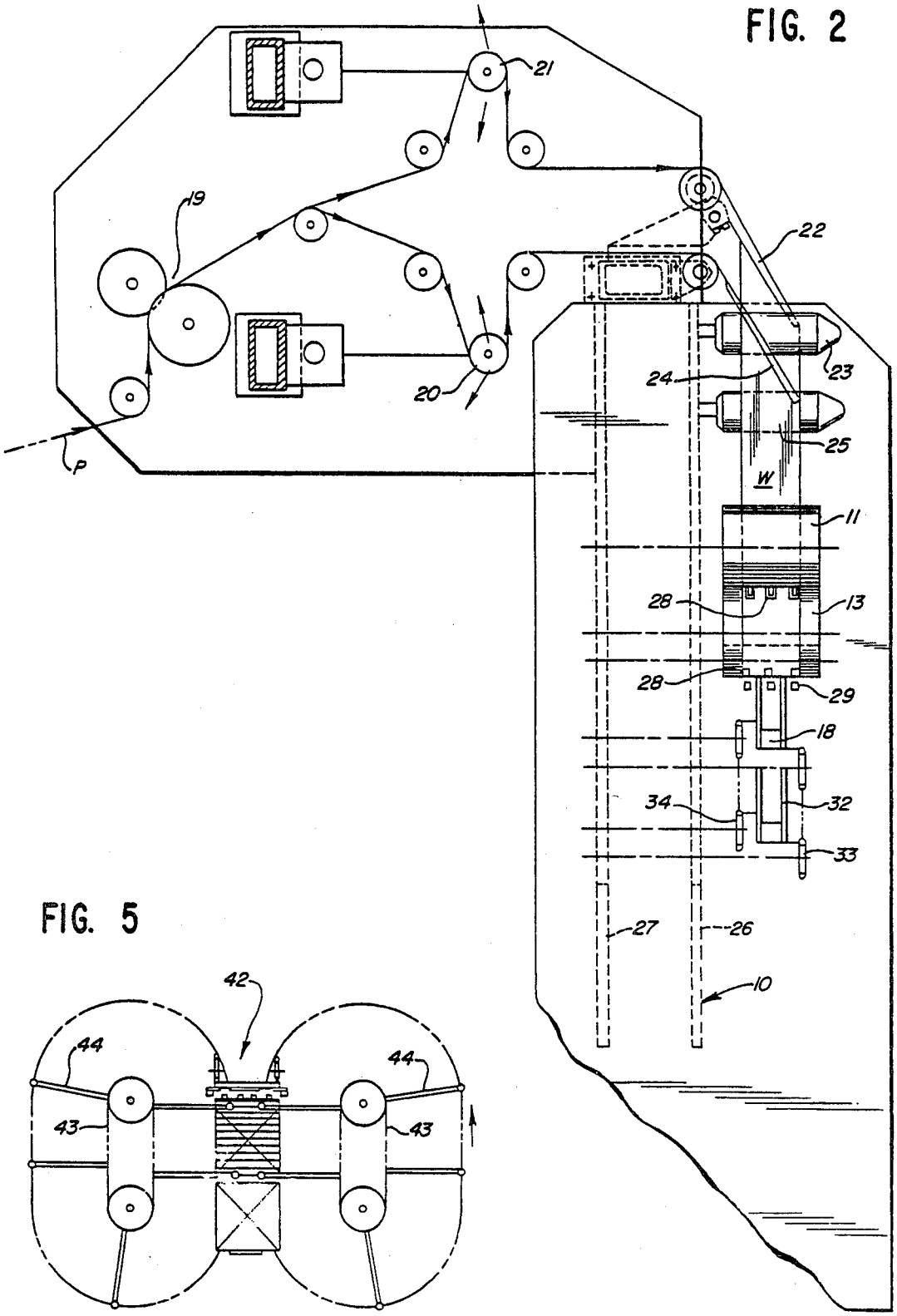
FIG. 2 is an end elevational view of the apparatus of FIG. 1.
FIG. 5 is a fragmentary sectional view such as would be seen along the sight line 5—5 as applied to FIG. 3.

Referring now to FIG. 2, a portion of the apparatus employed for supplying the webs W is seen as one would be looking from the left hand end of FIG. 1. A multi-width web P is derived from a parent roll (not shown) and advanced through a slitter 19 where the webs W are developed. In the illustration given, the multi-width web P is slit into five individual webs with three of the webs passing through the lower tension roll arrangement 20 while the upper two webs pass around another constant tension roll arrangement 21. Only the latter can be seen in FIG. 1. The two upper webs (which ultimately enter the delivery paths **14*a* and 14*c*) are delivered to folding boards 22 which perform a longitudinal folding operation in conjunction with pull rolls 23. The three alternate webs which are controlled by the constant tension roll arrangements 20 are likewise longitudinally folded by means of passing over folding boards 24 mounted in conjunction with pull rolls 25—these webs ultimately entering into delivery paths 14, 14*b* and 14*d***.

One of the operational advantages of the invention can be appreciated from a consideration of FIG. 2. There it will be seen that the rolls 23 and 25 are cantilever mounted on the frame 10 which consists of parallel walls 26 and 27. Thus, there is no obstruction on the front or operating side of the machine for the operator when threading the various webs through the delivery paths. Facilitating this threading are the rounded noses on the rolls 23 and 25 (see FIG. 2).

In the same fashion, the rolls 11–13 are also cantilever mounted for ready access, the only addition being a tie strap between the bearings supporting the front ends of each set of carrier and cutoff rolls 11 and 12. The carrier and cutoff rolls 11 and 12 are arranged to transversely sever the longitudinally folded web W into discrete lengths afterwhich the vacuum actuated carrier and folding rolls 11, 13 develop a transverse fold as illustrated schematically at f on the right hand side of FIG. 1. Rolls for this type of folding are conventional in the art—see, for example, Christman U.S. Pat. No. 1,974,149 and Bradley U.S. Pat. No. 3,870,292.

The practice of the invention is advantageous in the respect that by accumulating individual web units into substacks and subsequently accumulating substacks into larger stacks, high speed operation is achievable without the need for going to a multi-width machine. In the illustration of FIG. 2, only a single width web W is shown being processed along each delivery path, but it will be appreciated that means could be arranged to supply at least two side by side webs to increase the high speed productivity by a factor of at least 2. The preferred one-wide rolls as illustrated, or other multiple width rolls, can be cantilevered so that the vacuum collection for the rolls 11 and 13 are at the rear of the machine, away from the operator.

The folding roll 31 (see FIG. 2) is circumferentially grooved as at 28 to accommodate belts 29 constituting part of the transfer mechanism 15. Thus, as the transversely folded web unit F is brought around the folding roll 14, the belts 29 (along with the termination of the vacuum) cause the units to be stripped from the folding roll 31 and applied to the conveyor 16 where the units are advanced by the pushers 18, 18*a*, etc. The belts 29 besides being entrained on the folding rolls 13 are also entrained about an idler roll 30 so as to develop a belt run as at 31 which is generally parallel to the collection conveyor 16. In the instance of sizable thickness web units, the belt run 31 may be sloped as by adjusting the location of the idler rolls 30.

Relative to the conveyor pusher 18, it is seen from FIG. 2 that each pusher 18 includes a bracket 32 which is pivotally connected to link chains as at 33 and 34 and which cause the brackets 32 to remain vertical when accomplishing the turn arounds at both ends of the conveyor travel—see the left hand lower portion of FIG. 1. For this purpose, the conveyors 33 and 34 are mounted in vertically offset relation (see FIG. 2). In the illustration given, ten sets of cutoff-folding devices are provided. One group of five is seen in FIG. 1 with the parent roll (not shown) supply webs to the longitudinal folding boards 22 and 24 which are supported on an auxiliary frame generally designated 35.

Figure 3:
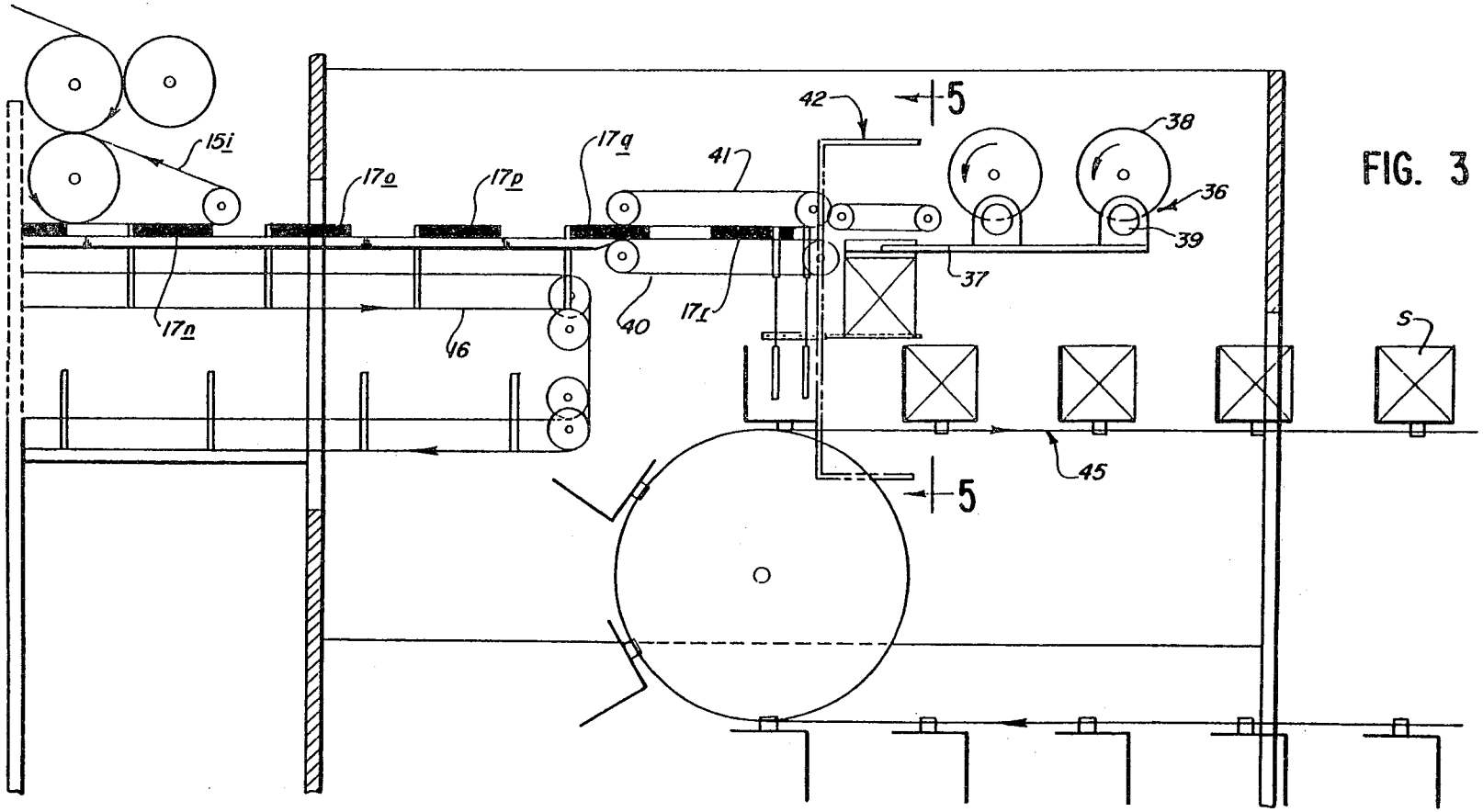
FIG. 3 is a fragmentary side elevational view of the discharge portion of the apparatus seen in FIG. 1.

A second identical auxiliary frame, parent roll and folding devices are provided with the tenth transfer mechanism being seen in the left hand portion of FIG. 3 and designated 15*i*. Thus, the arrangement described is adapted to deliver substacks of ten web units each, these substacks being accumulated at the rate of 600–750 web units per minute from each of the ten folding mechanisms involved, and thus, the total production from the plurality of ten folding mechanisms working according to this invention would be 6,000–7,500 units per minute. This compares with state of the art machines that are generally limited to four or five-wide folding mechanisms for total productions in the range of 2,400 to 3,750 units per minute. This significant improvement in total productivity is achieved when using only one-wide folding mechanisms according to the present invention—however, it is understood that each of the folding mechanisms could be two or more wide, and for example, if two-wide folding mechanisms were used, the delivery from each two-wide folding mechanism would be 1,200 to 1,500, and the total accumulated capacity from ten folding mechanisms would yield 12,000–15,000 deliveries per minute. In addition to the substantially higher productivity, other operating advantages include ease of threadup from the "open front" side of the frame, vacuum valves on one end of the rolls only, gears only on the "non-operator" side and which can be totally enclosed for safety, the opportunity to mix colors within the stacks and a stiffer, more stable item being accumulated in the packer—5 napkins being considerably stiffer than 1 or 2 maximum from state of the art machines.

In the upper right hand portion of FIG. 3, the packer is generally designated by the numeral 36 and is seen to have moving fingers 37 which follow an orbit as at 38 defined by the path of travel of the cranks 39 therefor. An orbital packer in a slightly different environment can be seen in U.S. Pat. No. 3,256,012.

As the substacks 17*n*–17*r* are advanced along the collection path 16 (see the left hand portion of FIG. 3), they are engaged by delivery belts 40 and 41 and delivered to a stacker generally designated 42.

Figure 4:
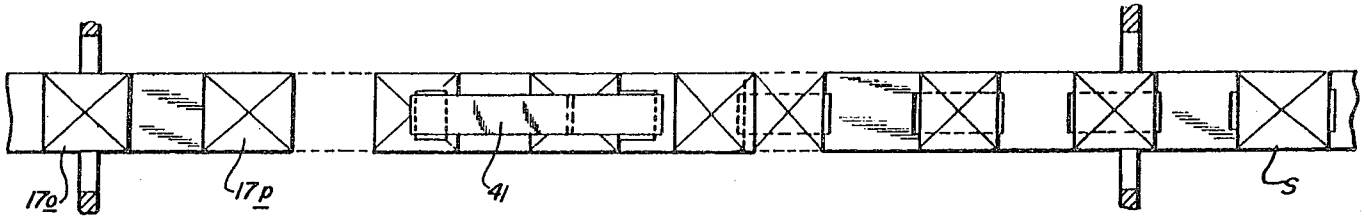
FIG. 4 is a top plan view of a portion of the apparatus seen in FIG. 3.

The stacker 42 (see FIG. 5) consists of a pair of mechanisms arranged in side-by-side relation having chains 43 carrying stacking fingers 44 which pass through an obround orbit, accumulating as many substacks between successive fingers as has been predetermined in the operation of the machine. The substacks which have been accumulated into a predetermined count stack are then transferred by means of a bucket conveyor generally designated 45 to a packing station (not shown). Such stacks are designated as at S in the right hand portions of FIGS. 3 and 4.

An advantageous feature of the invention is involved in the delivery system. Since the folding roll 13, the belts 29, and the collection conveyor 16 are all running at exactly the same speed, the relative velocity between the web product and the collection conveyor is zero. This means that there is no deceleration and stopping of the product involved and no acceleration in the transverse direction as one now has in all hanky and napkin folding machines. For this reason, the invention makes possible the production of uniform stacks at high speed. This feature of the invention can be particularly appreciated from a consideration of FIGS. 6 and 7.

Figures 6, 7:
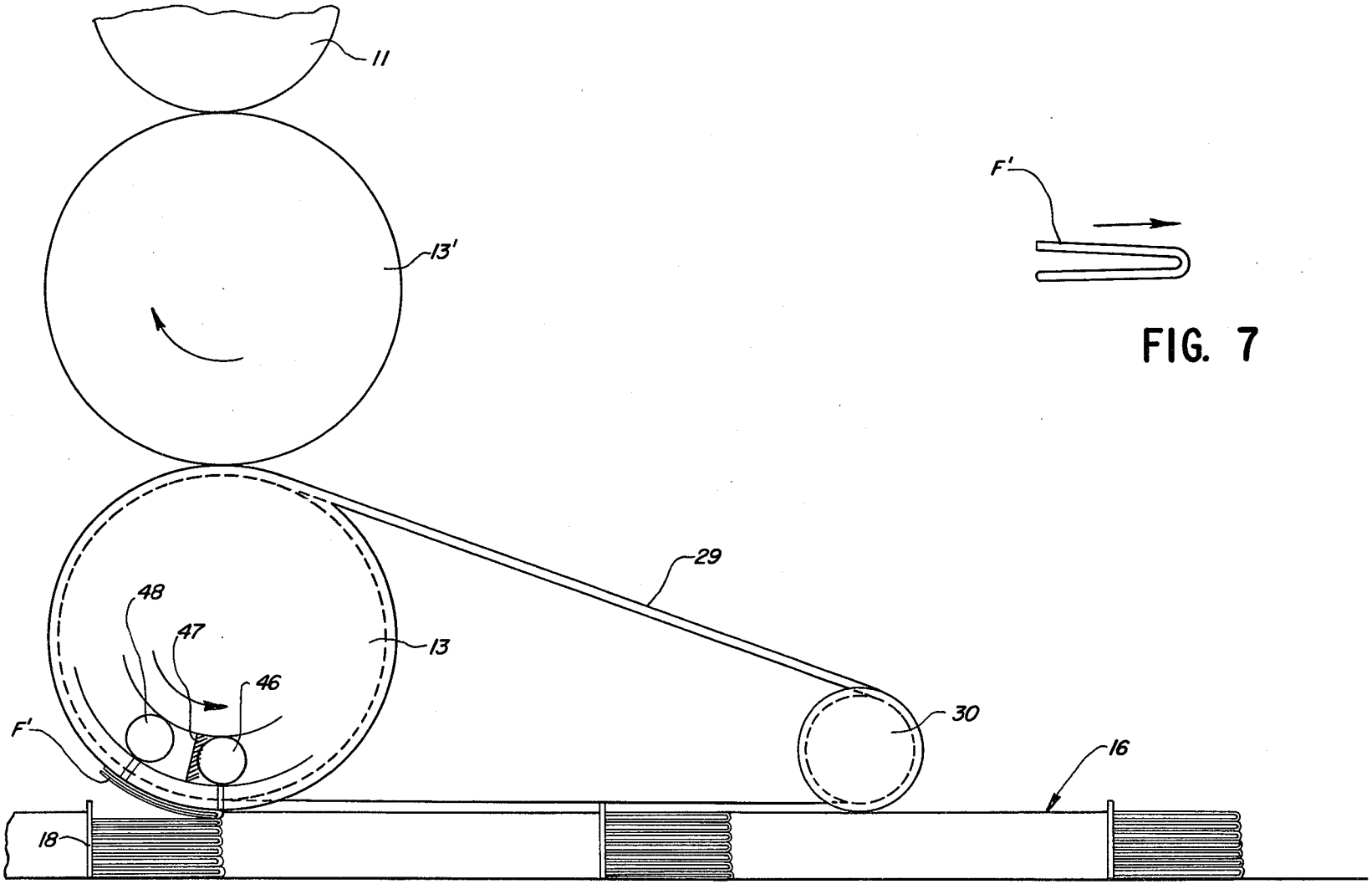
FIG. 6 is an enlarged, fragmentary side elevational view of a portion of FIG. 1.
FIG. 7 is a schematic representation of a folded web product.

In FIG. 7, a double transverse folded web product F' such as a hanky is seen. This is produced on apparatus similar to that of FIG. 1 but with the addition of a second folding roll as at 13' between the previously referred to carrier roll 11 and folding roll 13 (see FIG. 6).

In FIG. 6, the hanky F' is in the process of being laid down on a previously developed partial stack of 9 units. The leading vacuum port 46 has just been "blanked" (as at 47) to disconnect it from the vacuum source and thereby release the forward edge of the unit F'. As the folding roll 31 continues to rotate, the second vacuum port 48 comes into alignment with the blanking means 47, thereby releasing the rest of the unit. Each web is carried through the cutoff to the first folding roll 13' for the center transverse fold and to the second folding roll 13 for the second transverse fold. From the second folding roll 13, the hanky is deposited on the collection conveyor in time with the flights 18 on this conveyor.

Belts 29 running in grooves 28 on the second folding roll 13 strip off and deposit the hankies very uniformly. The collection conveyor is slanted and adjustable so that as each hanky is deposited on it, there would be the proper space for the build-up of the plurality of hankies.

It will be noted that the hankies are always trapped between the folding rolls 13 and stripper belts 29 on top, and the collection conveyor 16 and partial packs on the bottom for positive control of each hanky and elimination of windage as they are discharged in a horizontal delivery path and at high speeds, this can cause problems with the tendency of the hankies to open up. As illustrated in FIG. 7, the folding edge of the hanky in this case is leading, and this fact, along with the stripping and entrapment of the hankies at the port of discharge from the folding roll to the collection conveyor provides very uniform package buildup at high speeds.

While in the foregoing specification a detailed description of an embodiment of the invention has been set down for the purpose of explanation, many variations in the details hereingiven may be made by those skilled in the art without departing from the spirit and scope thereof.

I claim:

1. Apparatus for producing stacks of folded web units comprising a frame, a collection conveyor horizontally disposed on said frame, means operably associated with said collection conveyor for moving the same at a predetermined speed, a plurality of cutoff-transverse folding devices successively aligned along said collection conveyor terminating in a discharge end, each said cutoff-transverse folding device including a folding roll having an outer surface, means associated with said folding rolls for rotating the same to move said surface at said predetermined speed, means for separately, vertically advancing at said predetermined speed a plurality of continuous webs, one into each of said cutoff-transverse folding devices, said cutoff-transverse folding devices providing folded web units, means for controlledly transferring said folded web units from each of said cutoff-transverse folding devices to a series of points on said collection conveyor for advancing units thereon in synchronism with the units being delivered successively thereto to develop a series of stacks, each stack having a plurality of units therein, said transferring means including belt means for traveling on said folding roll in underlying relation to a web unit on said folding roll whereby said belt means travels at said predetermined speed, each said belt means being entrained about an idler roll spaced downstream relative to the path of collection conveyor movement from said folding roll to provide a length of travel generally parallel to said collection conveyor to confine each folded web unit as the same is superposed onto a previously transferred folded web unit, said surface of each of said folding rolls, each said belt means and said collection conveyor all being arranged so that at the point of transfer of a folded web unit all of said folding roll surface, belt means, folded unit and collection conveyor are traveling at the same speed and in the same direction whereby a folded web unit traveling with said folding roll changes direction progressively during transfer without any change in speed.

2. The apparatus of claim 1 in which an accumulator is provided at the discharge end of said collection conveyor for accumulating a number of said stacks into a larger stack.

3. The apparatus of claim 2 in which means are provided for continuously advancing at the predetermined speed the web units in both the delivery and collection paths, said paths being oriented so that said web units do not abruptly change direction until reaching said accumulator.

4. The apparatus of claim 1 in which said cutoff-folding device includes a vacuum port-equipped folding roll, said transferring means including belt means for traveling on said folding roll in underlying relation to a web unit on said folding roll.

5. The apparatus of claim 4 in which the web units, the surface of the folding rolls, the vacuum ports, the belt means, and the collection conveyor are all traveling at the predetermined speed.

6. The apparatus of claim 1 in which said cutoff-transverse folding devices are so oriented relative to said collection conveyor that the leading edge of a folded web unit is disposed forwardly whereby windage and control problems are considerably diminished at high speed.

* * * * *